US011666505B2

(12) United States Patent
De Marchena

(10) Patent No.: US 11,666,505 B2
(45) Date of Patent: Jun. 6, 2023

(54) METHOD FOR INDUCING A MEDITATIVE STATE

(71) Applicant: OMDYNE LLC, Miami, FL (US)

(72) Inventor: Eduardo Jose De Marchena, Miami, FL (US)

(73) Assignee: OMDYNE, LLC, Miami, FL (US)

( * ) Notice: Subject to any disclaimer, the term of this patent is extended or adjusted under 35 U.S.C. 154(b) by 9 days.

(21) Appl. No.: 16/652,738

(22) PCT Filed: Oct. 3, 2018

(86) PCT No.: PCT/US2018/054262
§ 371 (c)(1),
(2) Date: Apr. 1, 2020

(87) PCT Pub. No.: WO2019/070919
PCT Pub. Date: Apr. 11, 2019

(65) Prior Publication Data

US 2020/0237614 A1 Jul. 30, 2020

Related U.S. Application Data

(60) Provisional application No. 62/567,727, filed on Oct. 3, 2017.

(51) Int. Cl.
*A61H 23/02* (2006.01)

(52) U.S. Cl.
CPC . *A61H 23/0245* (2013.01); *A61H 2023/0209* (2013.01); *A61H 2201/1604* (2013.01); *A61H 2201/165* (2013.01); *A61H 2201/169* (2013.01); *A61H 2201/5025* (2013.01); *A61H 2201/5043* (2013.01); *A61H 2201/5058* (2013.01); *A61H 2201/5097* (2013.01); *A61H 2205/023* (2013.01); *A61H 2205/024* (2013.01); *A61H 2205/025* (2013.01); *A61H 2205/027* (2013.01); *A61H 2205/028* (2013.01)

(58) Field of Classification Search
CPC ..... Y10S 601/15
See application file for complete search history.

(56) References Cited

U.S. PATENT DOCUMENTS 2,635,175 A * 4/1953 Hodge ..... A61F 7/007 219/528
4,052,981 A * 10/1977 Bachmann ..... A61H 23/0263 601/134
4,920,956 A * 5/1990 Yamauchi ..... A61F 7/007 607/109
5,092,835 A * 3/1992 Schurig ..... A61M 21/00 600/15
5,421,799 A 6/1995 Rabin et al.
(Continued)

FOREIGN PATENT DOCUMENTS

KR 2000-0054650 A 9/2000
WO WO-2015173752 A1 * 11/2015 ..... A61B 5/4806

OTHER PUBLICATIONS

International Search Report for Application No. PCT/US2018/054262, dated Feb. 19, 2019 (2 pages).

*Primary Examiner* — Bradley H Philips
*Assistant Examiner* — Savannah L Gabriel
(74) *Attorney, Agent, or Firm* — Bookoff McAndrews, PLLC

(57) ABSTRACT

The present invention is a method and device for inducing or promoting a meditative state.

20 Claims, 6 Drawing Sheets

(56) References Cited

U.S. PATENT DOCUMENTS

| | | | | |
|---|---|---|---|---|
| 6,549,808 | B1 * | 4/2003 | Gisel | A61N 1/44 607/139 |
| 8,142,373 | B1 * | 3/2012 | Riles | A61H 23/02 601/71 |
| 8,758,279 | B2 * | 6/2014 | Karnwie-Tuah | A61H 23/02 601/46 |
| 10,688,274 | B1 * | 6/2020 | Jovanov | A61B 5/369 |
| 2005/0267388 | A1 * | 12/2005 | Hanna | A61H 23/02 601/70 |
| 2008/0027363 | A1 * | 1/2008 | Brueckmann | A61H 23/0263 601/46 |
| 2010/0113991 | A1 * | 5/2010 | Wu | A61H 9/0078 601/46 |
| 2013/0253388 | A1 * | 9/2013 | Juto | A61H 9/0078 601/48 |
| 2014/0064536 | A1 * | 3/2014 | Kim | H04R 5/033 381/333 |
| 2015/0224019 | A1 * | 8/2015 | Barbera | A61H 23/02 601/46 |
| 2016/0008219 | A1 * | 1/2016 | Pollak | A61H 23/02 601/46 |
| 2016/0030281 | A1 | 2/2016 | Shafieloo | |
| 2020/0114116 | A1 * | 4/2020 | Dubey | A61M 21/02 |

* cited by examiner

METHOD FOR INDUCING A MEDITATIVE STATE

CROSS REFERENCE TO RELATED APPLICATIONS

This application is the U.S. national phase entry under 35 U.S.C. § 371 of International Application No. PCT/US2018/054262, filed on Oct. 3, 2018, which claims priority to U.S. Provisional Patent Application No. 62/567,727, filed on Oct. 3, 2017.

I. FIELD OF THE INVENTION

The present invention relates to devices and methods for inducing a meditative state by imparting vibrations to parts of the head of a mammalian subject, thereby inducing or promoting a calming state during meditation.

II. BACKGROUND OF THE INVENTION

Meditation with chanting and breathing advances parasympathetic stimulation and indicates a state of wellness and calm. Devices are known that by mechanical vibration in a body cavity affect body functions, e.g. in the ear or over a body surface. In US 2008/281238, a system for increasing activity in the fundamental brain is disclosed. The disclosed system comprises a first and a second vibration applying device, the first of which applies vibrations having frequency components within an audible range to the auditory sense system of a living body. The second vibration applying device applies vibrations having super-high frequency components exceeding the audible range to another region than the auditory sense system, such as the nasal cavity.

RU 2199303 discloses a method of treating the neuroautonomic form of vasomotor rhinitis. More specifically, the method involves vibratory massage of the anterior third of the inferior and middle concha at a frequency of 50 Hz for 1.5-2 minutes in combination with vibratory massage of certain biological active points (BAP:s) located in the hand, chin and near the nose. The instrument used for delivering the vibratory massage is described as a vibromassage instrument having a ball and a tip.

US 2011/190668 discloses methods and systems for non-invasive neuromodulation of the sphenopalatine ganglion. An ultrasound transducer to treat migraine and cluster headache is described. The system includes an acoustic frequency, e.g. 0.44 MHz (typically in the range of 0.3 to 0.8 MHz), which permits the ultrasound to effectively penetrate through bone.

US 2007/149905 discloses a device for mechanically treating headache. Headache is treated by head massage carried out via a headpiece with vibrators in a frequency range of 50 to 350 Hz applied in bursts with a duty cycle of 10-20%.

Notwithstanding the usefulness of the above-described methods, a need still exists for a device and method for inducing a meditative state. The devices and methods of the present invention will induce a meditative state by mimicking or matching the sensation(s) and physical vibrations present when chanting the word "Om." Om is a mantra or vibration that is traditionally chanted during meditative sessions (such as yoga); the devices and methods described herein are a mechanical substitute for the chanting. A user can attach or connect the device to one or more various head regions, dial the user-determined frequency, and then experience the "Om" chanting meditative state.

It would be desirable to have a non-pharmaceutical apparatus for inducing a meditative state that is not invasive, does not require medical personnel to administer, and does not cause pain.

The devices and methods of the present invention alleviate the above-described problems and, in addition, provide variable frequency and other options that may be adjusted for each individual user, thereby optimizing user satisfaction and benefit.

III. SUMMARY OF THE INVENTION

The present invention provides novel systems, methods, and devices for inducing or promoting a meditative state.

An exemplary device includes: a vibration system comprising a vibration generator; at least one power source, to provide power to the vibration generator suitable for stimulating one or more nerves through vibration; optionally at least one amplitude control device which controls the amplitude of the vibration; optionally at least one frequency control device which controls the frequency of vibration; and a head-piece to be affixed to the user's head, which holds at least one component of the vibration system against the user's head. The device will do phasic vibration at intervals mimicking the meditative chant and breath. The user may chant and breathe at the same interval.

Optionally, the device further comprises a microprocessor or any control device that can pattern or vary the amplitude or the frequency, according to a program, or as desired by the user. Optionally, the device further comprises a memory device for recording all or some of the following: time, duration, frequency, and amplitude, position of vibrating plate and/or position of vibration generator, for review or diagnosis.

Some embodiments of the invention include a system for inducing or promoting a meditative state in a mammalian subject, including a human subject. The system may include a device for stimulating or inducing a vibration; a head set or head piece for transmitting a pre-determined frequency vibration to one or more pre-determined locations on the head or face; an electronic user interface; and/or an app for activating and controlling the function of the device. This will enhance and teach the meditative state. Vibration frequency can be altered to find the most responsive frequency in user. Further, the points of contact or attachment to the subject's body may be altered or fine-tuned to promote and achieve the optimum experience. In some embodiments of the invention, the device may provide feedback information that aids the user in adjusting the device to find and achieve the optimized combination of elements.

The invention also relates to a method of inducing a meditative state in a user, comprising the following steps: transmitting vibrations to the user's head and/or face.

With the following enabling description of the drawings, the apparatus should become evident to a person of ordinary skill in the art.

IV. BRIEF DESCRIPTION OF THE FIGURES

V. DETAILED DESCRIPTION OF THE INVENTION

A device of the present invention is a head piece having at least one zone that is a contact point(s) for inducing transferring vibrations in the patient. The device or head piece may include any element or combination of elements that induce a vibration(s) in the subject. In some embodiments of the invention, the element or elements is vibration transducer. In other embodiments of the invention, the element or elements may be a frequency transducer and/or a signal transducer.

In less preferred embodiments, the skin contact points or zones are the areas in which vibrations are induced in the bony structures of the head.

In preferred embodiments, the device includes five zones, described by form and function in more detail below. In preferred embodiments, all five zones may be turned on/off, e.g., according to pre-programmed functions and/or personal preference and comfort.

Figure 1:
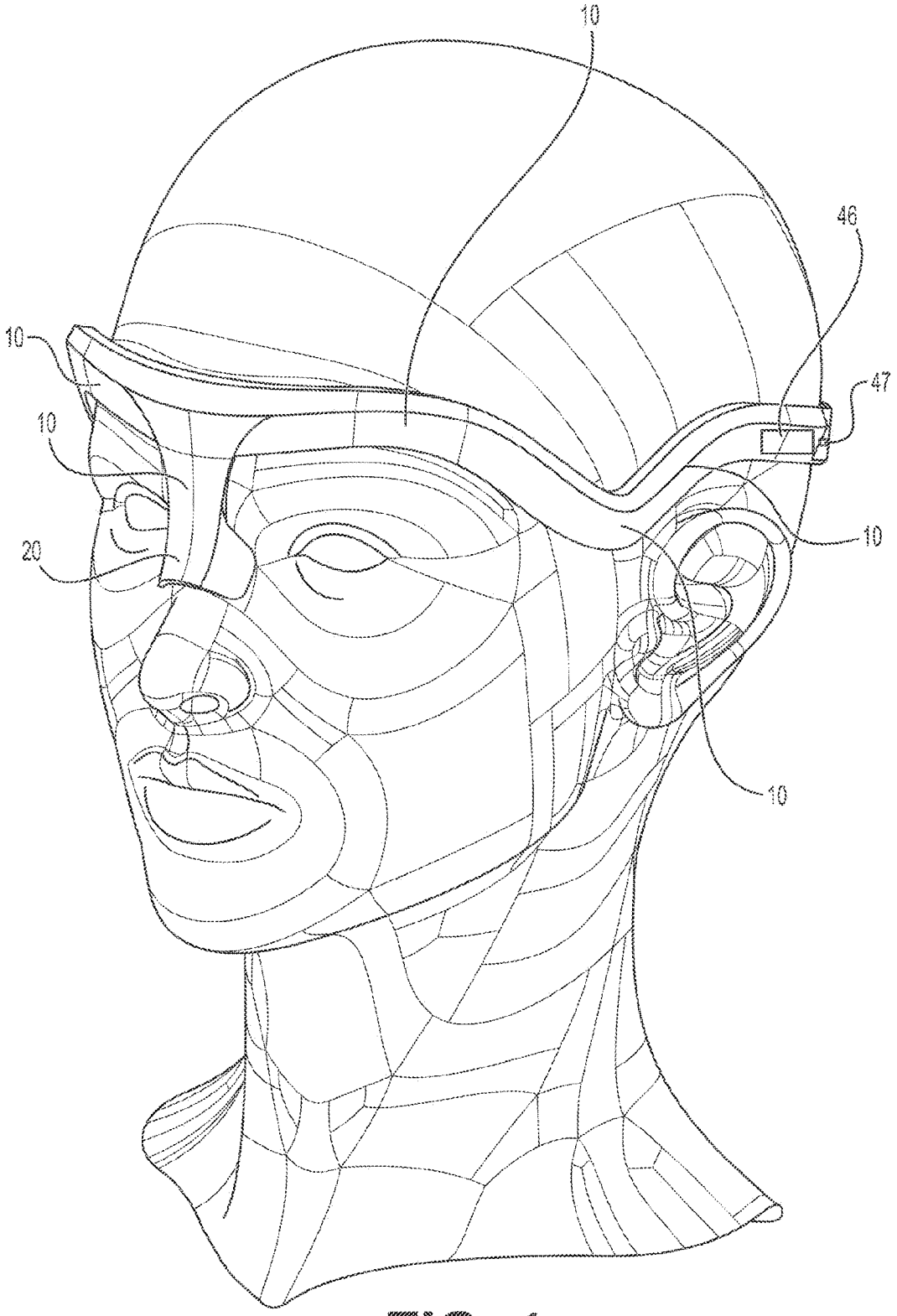
FIG. 1 shows a perspective view of an exemplary device of the present invention.
Figure 6:
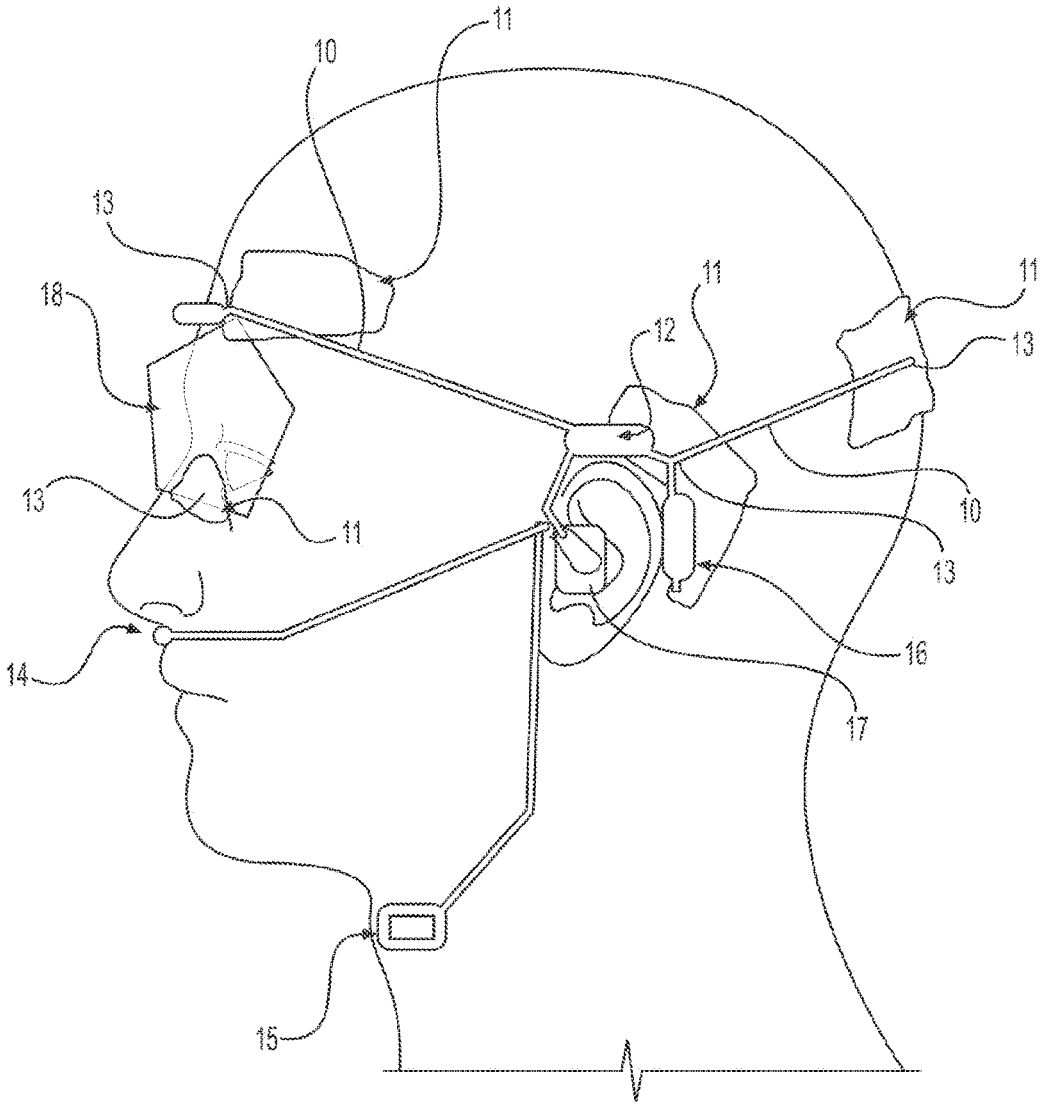
FIG. 6 illustrates an alternative head piece for inducing a meditative state in a user.

In accordance with the present invention, the head piece approximately circles the head, and optionally includes a segment or nose piece extending down onto the nose. The head piece includes any number of zones, one being the minimum, for transferring or causing vibrations in the underlying anatomy of the head and/or nose. Exemplary head pieces are illustrated in FIGS. 1 and 6.

In preferred embodiments of the invention, the head piece includes transducer zones near the eyes; along the temple; on the forehead; on the nose; and above the ears.

In some embodiments of the invention, the head set also houses a source of power, e.g., a rechargeable or non-rechargeable battery. In preferred embodiments, the head set includes a rechargeable battery and a USB port or the like for recharging the battery.

A head set of the present invention also includes one or more activation or interface buttons. These buttons control various functions, as desired.

Figure 4:
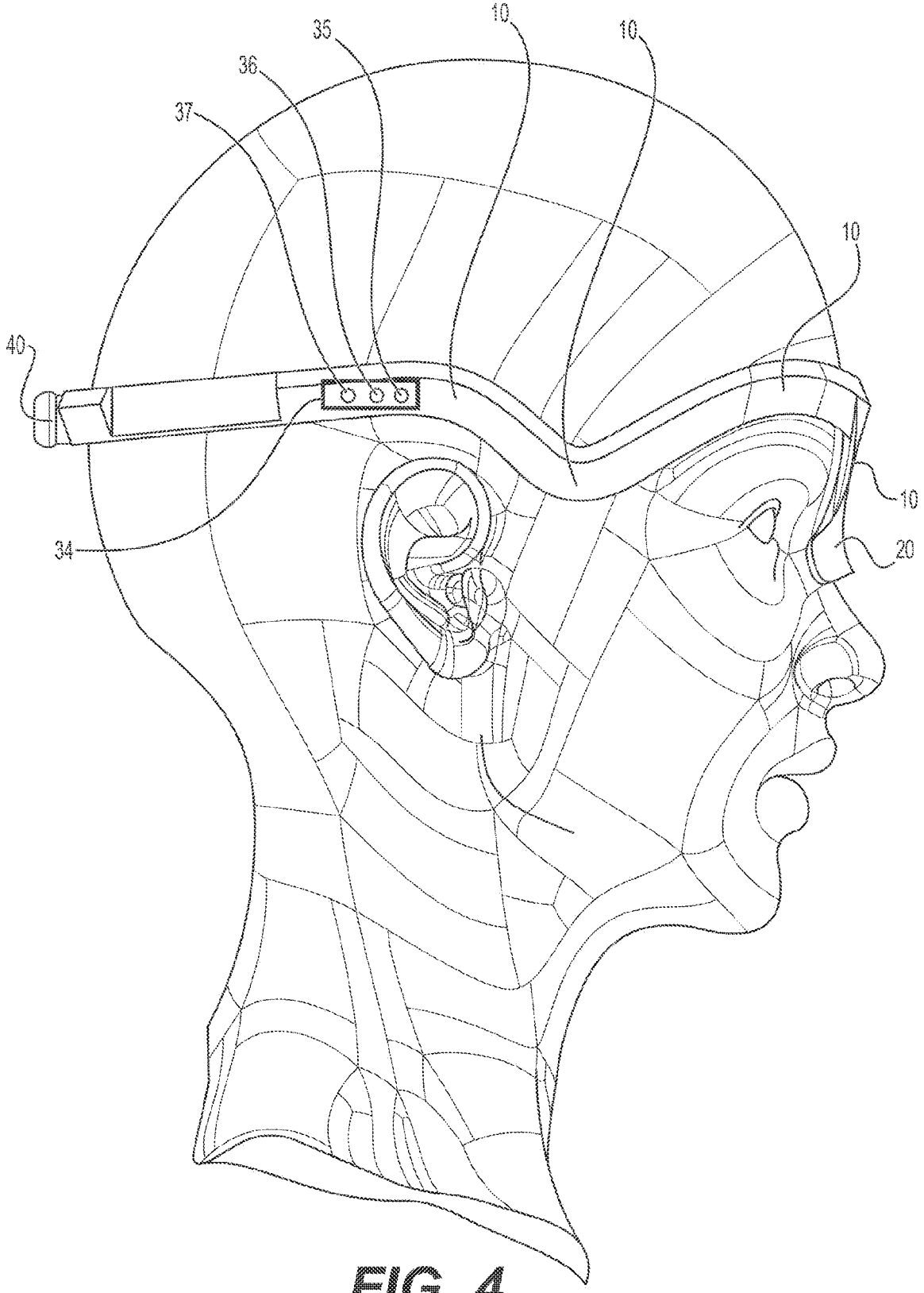
FIG. 4 shows a right-side view of an exemplary device of the present invention, and exemplary location of activation buttons.

In some embodiments, the head set includes a programming button 34. The programming button may turn the device on and off, perform other functions as desired, may program a training protocol, or combinations of any of the above. An exemplary configuration and placement of the programming button is shown in FIG. 4. In the illustrated embodiment, the programming button 34 includes an on/off switch 35, a zone activation button 36, and an amplitude button 37.

In some embodiments, the head set includes a zone activation button. In accordance with the present invention, the zone button may activate one or more zones, and/or may activate one or more zones in any pattern. In a preferred embodiment of the invention, the default setting or preferred setting has all five zones activated. For example, this button may activate the zones for the eyes and temple; or the ears and temple; or may rotate around any one or all of the zones. In preferred embodiments, the zone activation button activates all zones simultaneously.

In some embodiments, the head set includes an amplitude button. This button toggles the zones between one or more signal amplitudes. In the preferred embodiment, the head set may be toggled through five amplitude steps.

In some embodiments of the invention, the head set may include a nose piece 20 or section that conforms to the shape and size of the nose. The nose piece 20 may be fixed, as is shown in FIG. 1, or may swivel down over the nose (not illustrated). The nose piece may further include padding or the like to relay vibration from the device to the nose. In preferred embodiments, the nose piece, or a portion thereof, is movable, bendable or otherwise adaptable to conform to the shape of the subject's nose. The nose piece or nose section may also include one or more skin contact points or transducers.

In some embodiments of the invention, the head piece may include one or more structures or elements for securing the band to the skull. These elements include but are not limited to a tightening band; an elastic band or a portion of the head set that is elastic; an adjustable Velcro strap; and combinations thereof. The preferred element is a ratchet system or closure.

A device of the present invention for inducing or promoting a meditative state comprises: at least one signal generator capable of producing a signal having a frequency between 25-500 Hz; at least one transducer capable of transforming the signal generated by the signal generator into vibrations; at least one wire capable of transferring the signal generated by the signal generator to the transducer; at least one power source; and a headpiece capable of supporting at least one transducer.

The present invention involves a device for inducing a meditative state in a user. The device may include a signal generator; a skin transducer in communication with the signal generator, and suitable for generating vibrations in the bony structures of the head and face; and an operator interface for operating and controlling the device.

In some embodiments of the invention, the device comprises: a vibration system; at least one power source to provide power to the vibration generator; preferably at least one amplitude control device which controls the amplitude of the vibration; preferably at least one frequency control device which controls the frequency of vibration; and a head-piece to be affixed to the user's head, which holds at least one component of the vibration system against the user's head.

The invention also relates to a method of inducing a meditative state, comprising the following steps: transmitting vibrations to the user's head.

One skilled in the art will recognize that a device and methods of use may be incorporated into a system according to the invention.

Figure 2:
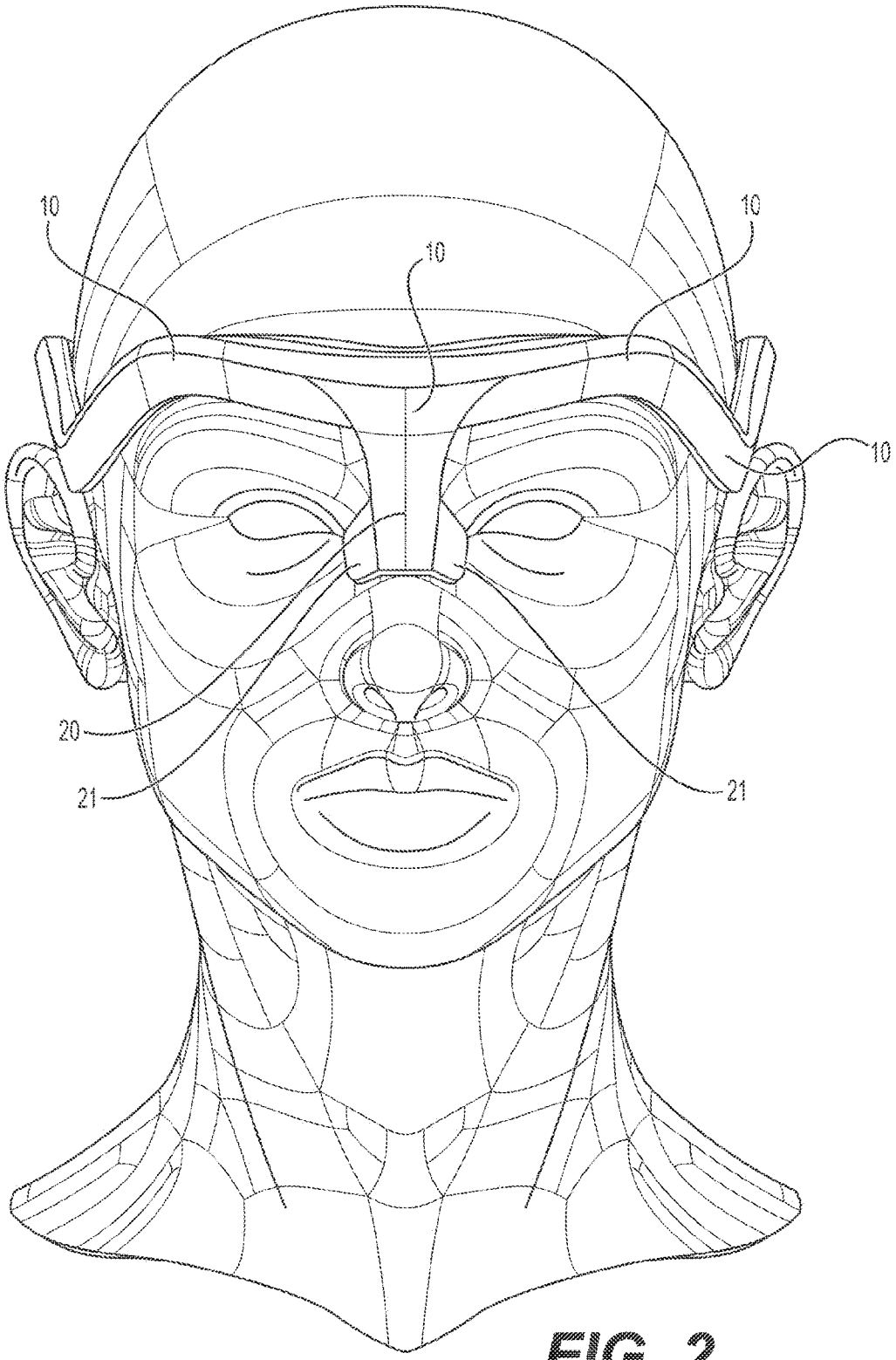
FIG. 2 shows a front view of an exemplary device of the present invention.
Figure 3:
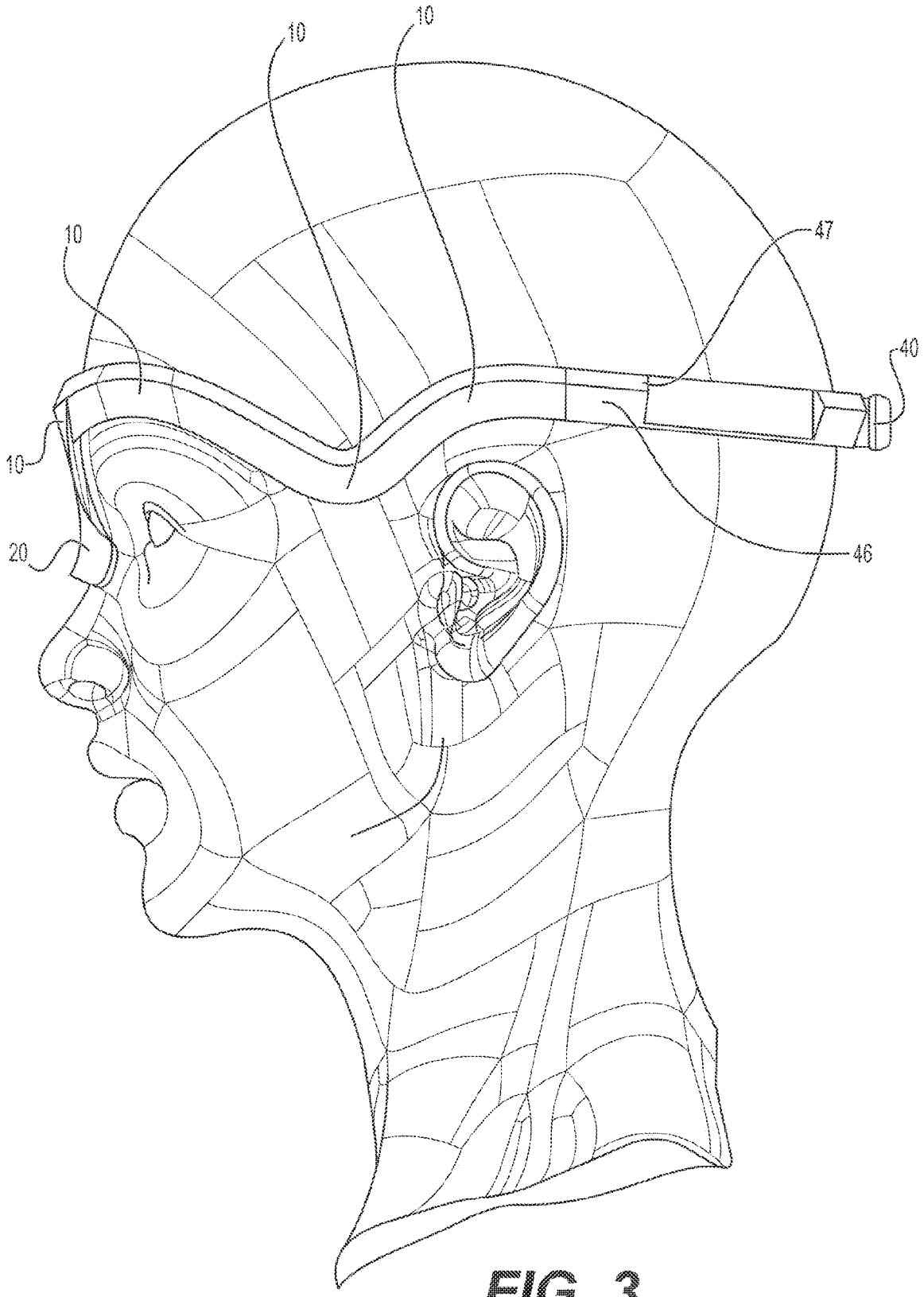
FIG. 3 shows a left-side view of an exemplary device of the present invention, and exemplary battery and USB port placement.

FIGS. 1-4 show an exemplary and preferred embodiment of the invention. FIGS. 1-3 show a head piece designed and configured to circle the head and containing multiple points 10 of contact. These point or points of contact are signal transducers for passing a signal to a body part that in turn vibrates at a specified frequency or frequencies.

FIG. 1 shows a head piece further including a nose piece 20. The nose piece may be variously adapted, shaped, and configured to conform to the shape and size of a typical nose. Nose piece 20 may also include one or more skin contact points 10 or transducers. FIG. 1 also shows exemplary placement of one or more skin contact points 10 or transducers.

FIG. 2 shows a front view of the head piece and the nose piece. This figure also shows that the nose piece may include one or more sections 21 that conform to the subject's nose, cheek, or head.

FIG. 3 shows an exemplary head piece and exemplary placement of one or more skin contact pints or transducers 10. This figure also shows exemplary placement or location of a battery 46 housed in the head piece. The figure also shows exemplary placement or location of an access door or USB port 47 for charging the battery.

FIG. 4 shows an exemplary head piece and exemplary placement of one or more skin contact pints or transducers 10. This figure also shows exemplary placement or location of a programming switch 34 on the head piece. As noted above, programming switch 34 may be variously configured and adapted to perform or activate a wide variety of functions. In the illustrated embodiment, the switch 34 includes an on/off switch 35, a zone activation switch 36, and a frequency or amplitude button 37.

Figure 5:
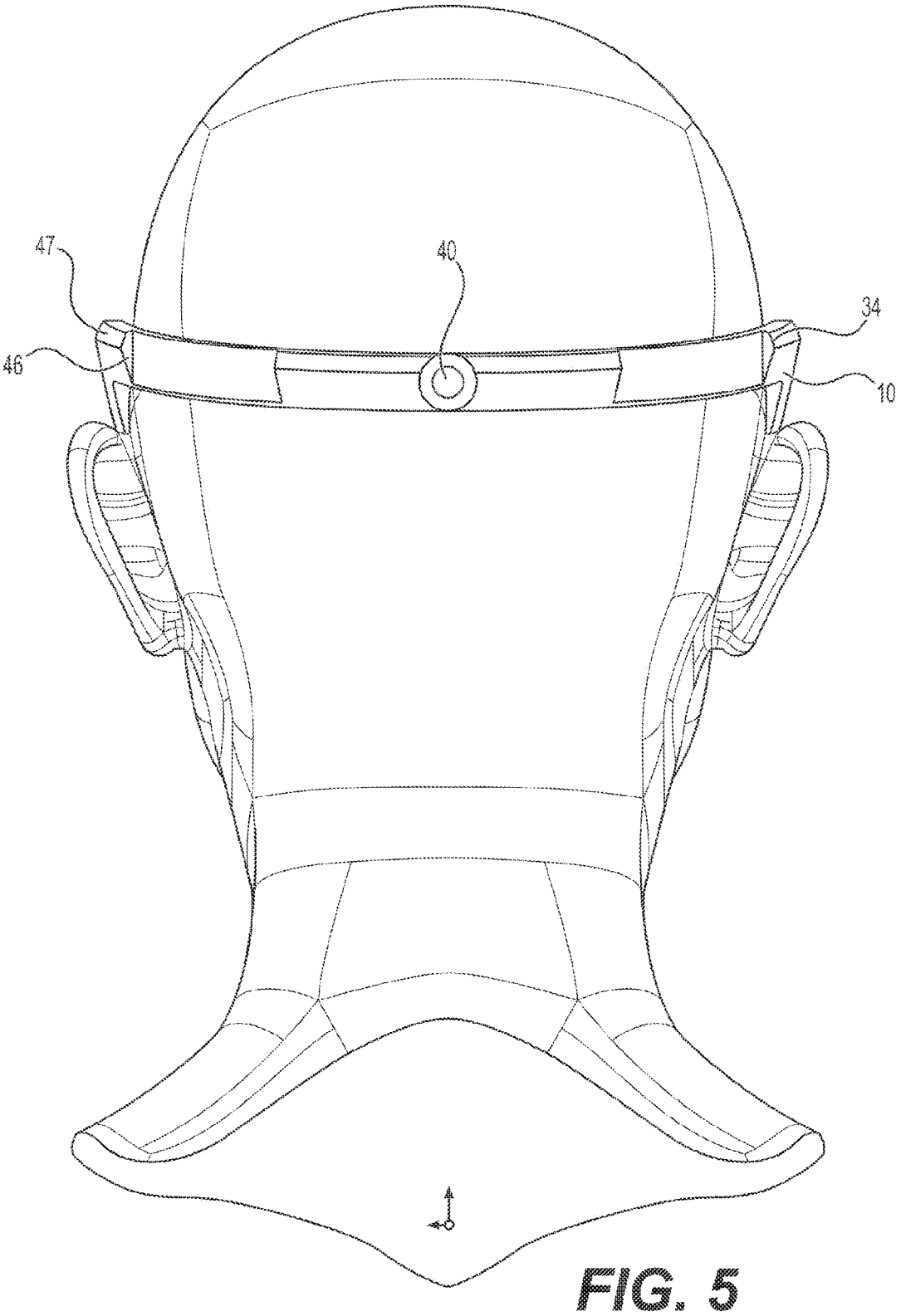
FIG. 5 shows a rear view of an exemplary device of the present invention.

FIG. 5 shows the rear of the head piece, illustrating one exemplary embodiment of an adjustable element 40 for securing the head band in place.

FIG. 6 shows an exemplary embodiment of the invention. The apparatus or headset comprises: a scaffolding system comprising one or more and or contacts 10 for contacting one or pre-determined locations 11 on a user's head or face; a microprocessor 12 or the like; one or more transducers 13, operated and controlled by the microprocessor and for creating transmitting a vibration to the skin, bone, and sinus areas near the point of contact.

In some embodiments of the invention, an electromechanical device will move a membrane that is in contact with the human interface. The electromechanical device will convert the electrical energy to mechanical energy according to the user interface or the algorithm and cause the change in the vibration output accordingly.

The device may optionally include one or more of the following: a respiration rate/volume sensor 14; a throat sensor 15; a pulse oxygen sensor 16; a head phone or ear piece 17; and a visual screen 18.

A system and/or device of the present invention may also include a power source, to provide power to the vibration or scaffolding system 10; a vibration generator, a vibrating plate or the like.

A head piece or system of the present invention may also include one or more interface devices for controlling the features and functions of the head piece and transducers. In some embodiments of the invention, the interface device may be a smartphone and/or an app. In other embodiments, the interface device may be a remote control. An interface device of the present invention may include one or more of the following: a frequency controller; operational interfaces for start, stop, save, etc.; an amplitude controller; one or more zone contact controllers; a contact quality visual display; and a screen for various displays, including but not limited to contact zones and any other general information.

A head piece of the present invention may be operated or controlled by one or more algorithms operable on one or more microprocessors. Exemplary input/output algorithm for operating the device may include one or more of the following: a heart rate monitor; a pulse oximetry controller; respiration rate; air flow sensor near the nose; sound or sound sensor; vibration or vibration sensor; user interface controllers; frequency modulation; and frequency intensity.

The Vibration System

The vibration system 10 comprises at least one vibration generator. Preferably, the vibration generator is capable of producing vibrations over a range of frequencies, preferably from about 5 to about 1000 hertz, more preferably from about 10 to about 750 hertz, even more preferably from about 25 to about 500 hertz. The most preferred range is between about 450 hertz and about 550 hertz. While a vibration generator that produces vibration at one frequency is also suitable, it is less preferred. If one frequency is used, the frequency should be between about 425 hertz and about 440 hertz. The vibration generator is preferably a piezoelectric device, which preferably vibrates between 25 and 500 Hertz.

Optionally, the vibration generator is capable of producing vibration over a range of amplitude, so that the amplitude may be adjusted by the user, preferably from 0 to 5 mm, more preferably from 0.005 mm to 5 mm, more preferably from 0.01 to 2 mm, even more preferably from 0.01 to 1 mm, more preferably from 0.05 to 0.5 mm.

Suitable vibration generators are known and commercially available; for example, they may be devices that produce vibrations through oscillation or wave-form generators. Vibration generators such as used in personal pagers carried by medical personnel are suitable. Piezoelectric vibration generators and MEMS vibration generators have the advantages of compact size and low power requirements. A suitable vibration generator is a piezoelectric device, which vibrates between 25 and 500 Hertz.

Conventional wave-form generators are suitable as a vibration generator; a suitable wave-form generator is available under the designation 4010A 2Mz function generator, from B+K Corporation, Yorba Linda, Calif. Where a wave-form generator is employed, different wave forms are used to produce the vibrations: sinusoidal wave-form, square wave and the like, or combinations thereof.

A suitable skin transducer is available under the designation Model VBW32 from Audiological Engineering Corp, Somerville, Mass. The Model VBW32 skin transducer which has a hook fastener on the back, has the following specifications: 1 inch by 0.73 inches by 0.42 inches thick; weighs 6.5 grams; a coil resistance of 32 ohms, a 250 Hz nominal peak frequency; with a usable output at reduced levels of 100 Hz to 800 Hz; an amplitude range from sensory threshold to 50 dB above threshold; a transient response time of 5 milliseconds; a 200 milliwatts power consumption and a nominal voltage drive of 2.5 volts rms.

The Power Source

The power source providing electrical power to the device may be any conventional power source, such as, a conventional AC power line or alternatively may be battery or solar operated, as may be necessary for providing an ambulatory unit. The device is optionally operated using 110 or 120 V electrical power. Where batteries are used, lithium ion batteries which are rechargeable for providing a portable device are suitable. Optionally, the power source is disposed in or on the vibration generator or in or on the head-piece. As shown in FIG. 1, the head piece may house or be configured with a battery 46 and, optionally, a USB port 47 or the like for recharging the battery. The USB port lies directly behind the battery on the left-hand side of the device.

The Head Piece

The head-piece 10 is adapted to fit the user's head and is optionally made of material sufficient to support the weight of the vibration system. In one embodiment, the head-piece is a framework configured to encircle a user's head. Typical frameworks are lightweight and may be made from any suitable material, e.g., plastic, rubber, or composites. The preferred materials are rubber or a silicon-like rubber.

In some embodiments of the head piece, such as shown in FIG. 1, the head piece is roughly circular so that it circles the head. A portion may be adapted or configured to align with the temple region of the head.

The head piece may be formed of any material suitable for transferring signals to an underlying body part. Materials include but are not limited to: rigid plastic; bendable or moldable plastic; elastic; fabric; rubber; siliconized rubber; and combinations thereof.

In alternative embodiments, the head-piece may be eyeglasses, a frame, and/or a virtual reality headset. In another embodiment, the head-piece is equipped with adhesive material for affixing the head-piece to the user's head. In an alternative embodiment, the head-piece is in a form such as a hat or cap which is adapted to fit over the user's head. The head-piece is optionally adjustable to the user's head using conventional fasteners such as for example, snaps, a buckle, hook fasteners, strings for tying, or by elastic and the like.

At least one vibration source is disposed on or in the head-piece. The vibration source is either one or more vibration generators or one or more vibrating plates or a combination of one or more vibration generators and one or more vibrating plates. The vibration generators and vibrating plates may be fixed to the head-piece or disposed on the head-piece in such a manner that their positions may be changed.

The exemplary apparatus of FIG. 6 includes a vibration generator (signal generator) in circuit communication with a skin transducer. The skin transducer is carried by a head gear framework as shown. The skin transducer may be placed along the framework corresponding to pre-determined locations, e.g., the side of the nose; on the forehead, behind the ear, and the back of the head; and directly in contact against skin of the region of the head being treated.

In the alternative, other skin transducers that vibrate or otherwise present rapidly changing information to the tactile sensory system may be used. The vibration generator may be remote from the skin transducer and in circuit communication with the skin transducer via electrical signal wires. Additionally, the device may include a user interface that may be used to selectively adjust the amplitude of the signal transmitted to the skin transducer and hence selectively adjust the amplitude of the vibrations applied to the user.

In addition, the device may include a power switch and a power LED.

Preferably, at least one vibration generator is disposed on or in the head-piece using conventional techniques and devices. For example, the vibration generator is located: within the material of the head-piece; in a pocket created in the head-piece; or attached to the head-piece using conventional fasteners such as for example, snaps, screws, rivets, buckles, clips, hook fasteners such as available under the trademark Velcro.® Preferably, the vibration generator is affixed to one location on the head-piece; alternatively the vibration generator is variably affixed to permit the position of the vibration generator to be easily changed.

Preferably, the power source is affixed to one location on the head-piece; alternatively the power source is variably affixed to permit the position of the power source to be changed.

Amplitude Control Device and Frequency Control Device

The apparatus, head piece, or user interface controller may further comprise an amplitude control device, element, or feature which controls the amplitude of the vibration. The amplitude control device is conventional.

The apparatus, head piece, or user interface may also include a frequency control device or element which controls the frequency of vibration. Optionally, the amplitude control device and frequency control device are contained in a single unit for ease of use. The frequency control device is conventional.

The amplitude control device and frequency control device are optionally disposed in or on the head-piece, or, separate from the head-piece. For example, the amplitude control device and frequency control device may be a hand-held device or smart phone (with an appropriate app). The amplitude control device and frequency control device are electrically connected to either or both the vibration generator and the vibrating plate; the connection itself is by an electrically conducting wire, or wireless, and/or Bluetooth.

A device of the present invention may include one or more microprocessors that can pattern or vary the amplitude or the frequency, according to a program, or as desired by the user. Optionally, the device further comprises a memory device for recording time, duration, frequency, amplitude, position of vibrating plate and/or position of vibration generator, for review or diagnosis.

Method of Use

Users wishing to induce or promote a meditative state can do so by applying at least one vibration source to the head and/or face, preferably near or on one or more of the following: the bridge of the nose, or on the side of the bridge; on or near the eyebrow area; on or near the area behind the ear; and on or near the back of the head. An exemplary placement arrangement is shown in FIGS. 1 and 6, but the invention should not be limited to such exact placement.

In preferred embodiments of the invention, the device includes one or more feedback monitors that allow the function of the device to be optimized for a particular user and/or for a particular session. Exemplary feedback conditions include, but are not limited to breathing rate, temperature, brain wave pattern, strength of transducer contact, pulse oxygen content, and an assortment of other conditions that alone and in total comprise total user satisfaction and contentment.

The method of inducing or promoting a meditative state in a user may comprise one or more of the following steps: transmitting vibrations to the user's head and/or face. Optionally, the method further comprises the step of adjusting an amplitude control to obtain optimal user satisfaction, either objectively obtained or subjectively evaluated. Optionally, the method further comprises the step of adjusting a frequency control to obtain more intensive vibration depending on the user's preference. Typically, the vibration source is placed against the user's head for about 5 to 60 minutes, although the exact time will vary depending on the user.

Devices and systems of the present invention may further include one or more optional elements and/or capabilities: a respiration rate/volume sensor in communication with the head gear framework; a throat sensor in communication with the head gear framework; a pulse oxygen sensor in communication with the head gear framework; a "heads-up display" element, such as a screen or eyeglass, in communication with the head gear framework; one or more programming buttons; one or more feedback mechanisms; one or more pre-programmed functions buttons/and or capabilities; one or more display interfaces showing the quality of transducer contact with the skin; one or more timers; one or more variously configured run cycles; a source of sound or music, e.g., music or chanting or calming sound patterns; and a cadence monitor, e.g., for promoting proper breathing rhythm and depth.

In a system of the present invention, at least one of the parameters vibration frequency, vibration amplitude and abutting pressure may be independently regulated. The regulating modules of the system are controlled by means of a control unit. In an alternative embodiment, they could be controlled manually.

A system, device, and method of the present invention may include a training program or protocol. The training program will guide the user in how to follow Om chanting meditation guidelines while providing supplemental vibration transduction. The device follows a sequence of steps that will indicate to the user when they are to perform certain actions. For a period of 4 seconds the device turns itself off. During this period the user is instructed to inhale through their nose. Following which the device turns back on for a period of 8-10 seconds. The signal produced increases rapidly to its maximum and holds for 6 seconds. The vibration then decreases over the next 2-4 seconds until the device turns off for the next cycle. During the period that the device is vibrating, the user is instructed to say or hum Om in one breath throughout the duration.

The regulating modules are arranged to control their respective outputs. In this context, control should be understood as delivering a constant value. This can be either a fixed value being constant for all treatments, meaning that the regulating module either delivers this particular value or no output at all. An alternative is that the regulating module can accept an input adjusting the delivered output value. It is within the scope of the invention that two or three regulating modules are comprised within the same regulating module. An example could be an oscillation pump comprising a piston reciprocating within a cylinder, such a pump can be used as a frequency and amplitude regulating module. In such a case the amplitude would typically be fixed (corresponding to the stroke of the piston) and the frequency would be possible to vary (e.g. corresponding to a rotation rate of a motor driving the piston). The stimulation member of the system may be positioned in one or more zones about the head and face. The embodiment shown in FIG. 65 provides eight zones of, four for each side of the head. Vibratory stimulation in a first location may stimulate bone/nerve structures in a second or other locations, including but not limited to mechanically transmitting vibrations to e.g. the hypothalamus.

In another embodiment, the system comprises a plurality of devices each comprising geometrically different stimulation or vibratory members. The stimulation members may for example differ in shape as well as in length, width and/or diameter. By selection and use of a stimulation member from a plurality of stimulation members, any influence differences in face or head anatomy may have on stimulation is reduced. In embodiments where the system comprises an analyzing module, such a module may moreover be arranged to compare the response received by stimulation with a specific stimulation member with an expected response range. If the response received does not correspond to the expected response, the analyzing module may prompt e.g. an operator to exchange the stimulation member accordingly. The individual devices comprised within the plurality of devices may be specific for treatment of different parts of the head or face.

In one embodiment, the user interface is further arranged to instruct the user where to position the stimulation member, said position being selected from the locations shown in the Figures and any of the locations described in this specification.

In one embodiment, the user interface is further arranged to receive input information related to the type and position of the stimulation member, and wherein the control unit is arranged to receive this information from the user interface and direct vibrations accordingly. Thus, dependent on the type and position of the stimulation member, different vibration stimulation parameters may be applied.

In one embodiment the interface is arranged to receive a confirmation input from the user confirming that instructions regarding type and position of stimulation member have been followed.

The stimulation member, and in particular the stimulating portion, may furthermore be arranged to abut against tissue in different parts of the head and face. This provides direct contact between the stimulation member and the tissue of the head and face, and indirect contact with the underlying bones. Moreover, the stimulation member can be arranged to abut against the tissue of the head or face at a pressure of between approximately 20 and 120 mbar.

In one embodiment, the control unit is arranged to direct vibrations to the head and face by controlling the pressure regulating module to adjust the pressure at which the at least one stimulating portion abuts against the tissue to be in the range of 20 to 80 mbar.

In addition, the stimulation member may, in one embodiment, be arranged to impart vibrations at a frequency of between 40 and 100 Hz to the nasal cavity, such as between approximately 50 Hz and 80 Hz, such as between approximately 50 Hz and 70 Hz, such as between approximately 60 Hz and 70 Hz. The applicant has found that such low frequency vibrations applied to tissue in the head and neck may provide effective treatment for inducing a meditative state.

Some embodiments of the invention include a system for inducing a meditative state in a human subject, comprising a device comprising a stimulation member arranged to contact a portion of the head or face and to impart vibrations to the nearby boney structures of the human subject, and at least one of a frequency regulating module arranged to adjust the frequency of the vibrations imparted by the stimulation member of the device to the head or face; an amplitude regulating module arranged to adjust the amplitude of the vibrations imparted by the stimulation member; and a pressure regulating module arranged to adjust the pressure at which the stimulation member contacts the head or face.

In one embodiment, the system may for example comprise at least two regulating modules selected from a frequency regulating module, an amplitude regulating module and a pressure regulating module. In another example, the system comprises a frequency regulating module, an amplitude regulating module and a pressure regulating module.

There is provided, in another aspect of the present invention, a device for treatment of a disorder in a human subject, comprising a stimulation member arranged to impart vibrations to the head and/or face of the human subject such that the disorder is treated; wherein the device is connectable to a vibration generating member arranged to bring the stimulation member to vibrate. The device according to the second aspect may be used for treatment of a headache disorder, such as a primary and/or secondary headache disorder, by administration of vibrations to the nasal cavity. The stimulation member of said device is, in one embodiment applicable to both device and system aspects of the present invention, arranged to abut against the tissue of the nasal cavity at least one pressure of between approximately 20 and 120 mbar. Thus, the stimulation member provides direct contact with the tissue of the nasal cavity. Moreover, the stimulation member can be arranged to abut against the tissue of the nasal cavity at a pressure of between approximately 50 mbar and 120 mbar, such as for example between approximately 70 mbar and 110 mbar, such as for example between approximately 75 mbar and 100 mbar. In one example, a relatively low pressure is exerted on the tissue, e.g. a pressure in the range of between approximately 20 mbar and 50 mbar. In another example, a relatively high pressure is exerted on the tissue, e.g. a pressure in the range of between 70 and 120 mbar. During vibration stimulation with a device according to the second aspect, the pressure may be held constant or may be changed, manually or by a system.

In another embodiment, applicable to device and system aspects of the present invention, the stimulation member is arranged to impart vibrations in at least one frequency of between approximately 40 and 100 Hz to the face and/or head. Thus, it should be understood that vibration stimulation may be performed at one selected frequency, e.g. 68 Hz, or at several frequencies within a predetermined frequency interval, such as between approximately 50 Hz and 80 Hz, such as between approximately 50 Hz and 75 Hz, such as between approximately 55 Hz and 75 Hz, such as between approximately 60 Hz and 75 Hz. Consequently, during vibration stimulation the frequency may be constant or changed, for example manually or by a system.

The stimulation member may be brought to vibrate such that vibrations are imparted to the selected treatment area of the head and/or face. The pressure exerted on the selected treatment area may for example initially be relatively high, such as between approximately 71 and 120 mbar. After a predefined period of stimulation at a relatively high pressure, the pressure may be lowered, for example to a relatively lower pressure such as between approximately 20 and 70 mbar, and/or the treatment area may be changed.

It is contemplated that vibration stimulation may be performed with at least one stimulation member in a first location or position on the human subject. For example, one device according to the first aspect may be used for single stimulation in one position only, or for sequential stimulation in one or multiple locations. In another example, two devices according to the first aspect may be used for simultaneous vibratory stimulation in both positions. It should be understood that pressure and vibration frequency may be the same or different for sequential and/or simultaneous stimulation in both positions. Two different vibration frequencies with a phase and/or amplitude difference may be applied during simultaneous stimulation to achieve an interference effect.

Prior to stimulation, the method may involve selecting from a plurality of devices comprising stimulation members having individually different geometry a device comprising a stimulation member having a geometry suitable for a specific treatment area within a specific location of a particular human subject. Certain users might require a stimulation member having a certain shape, length and width/diameter In addition, a treatment duration suitable for the user in question may be selected prior to initiating stimulation. Such selection may comprise selecting a minimum duration for standard stimulation, such as at least 5 minutes in total. Alternatively, the treatment duration may be defined as the period of treatment after the measure of meditative state has fulfilled a predetermined requirement. Such as after the first threshold is reached, stimulation may continue for yet another 2-5 minutes. Other treatment regimens involve selecting a duration of treatment in a first and/or second anatomical position.

The devices and methods of the present invention may also be used to teach and/or train the user to achieve a meditative state. These embodiments of the invention include a method training a user to achieve a meditative state by using a device as described herein, and using biofeedback to select and achieve the user's preferred meditative state.

While the invention has been described in some detail by way of illustration and example, it should be understood that the invention is susceptible to various modifications and alternative forms, and is not restricted to the specific embodiments set forth in the Examples. It should be understood that these specific embodiments are not intended to limit the invention but, on the contrary, the intention is to cover all modifications, equivalents, and alternatives falling within the spirit and scope of the invention.

I claim:

1. A wearable device, comprising:

a band configured to wrap around a circumference of a head of a user;

a plurality of contact points positioned on the band along a central axis of the band, each contact point comprising a transducer electrically coupled to a signal generator;

wherein each transducer is positioned between the band and the user and receives a signal from the signal generator to impart vibrations from the transducers to the head of the user at a first frequency of between approximately 25-500 Hz;

a nose piece segment extended downward from the band to be positioned onto a nose of the user; and at least one nose transducer configured to be positioned between the nose piece segment and the user and positioned over a bridge of the nose of the user and coupled to the signal generator, and wherein the at least one nose transducer is configured to receive a signal from the signal generator to impart vibrations to a nasal cavity of the user at a second frequency of between approximately 40 and 100 Hz.

2. The device of claim 1, wherein the band is configured to expose a top of the head when the band is around the head of the user.

3. The device of claim 1, wherein the nose piece segment is fixed.

4. The device of claim 1, wherein the nose piece segment further comprises padding to relay vibration from the device to the nose.

5. The device of claim 2, wherein when the band is worn by the user, each of the plurality of contact points of the band corresponds to locations of the head of the user.

6. The device of claim 2, wherein the device comprises at least five contact points, each of the at least five contact points being positioned to correspond to locations of the head of the user, and wherein the locations comprise a bridge of a nose, each of the user's temples, and above each of the user's eyelids.

7. The device of claim 1, wherein the band comprises a ratchet system to adjust a circumference of the band.

8. The device of claim 1, wherein the second frequency of the at least one nose transducer of the nose piece segment is between approximately 50 Hz and 80 Hz.

9. The device of claim 1, wherein the second frequency of the at least one nose transducer of the nose piece segment is between approximately 50 Hz and 70 Hz.

10. The device of claim 1, wherein the band is configured to wrap around an entire circumference of the head of the user.

11. A method, comprising:

arranging a band of a wearable device around a head of a user, the wearable device comprising a plurality of contact points on the band, each contact point comprising a transducer positioned between the band and the user; and receiving, by one or more of the transducers, a signal from a signal generator, thereby imparting vibrations from one or more of the transducers to a first location of the head of the user at a first frequency of between 500-550 Hz;

positioning at least one nose transducer between a nose piece segment and the user, and over a bridge of a nose of the user wherein the nose piece segment extends extended downward from the band and is positioned onto the nose of the user; and receiving, by the at least one nose transducer, another signal from the signal generator, thereby imparting vibrations from the at least one nose transducer to a nasal cavity of the head of the user at a second frequency of between approximately 40 and 100 Hz.

12. The method of claim 11, further comprising: maintaining the band around the head of the user and imparting vibrations for approximately between 5 to 60 minutes.

13. The method of claim 11, wherein the second frequency of the at least one nose transducer of the nose piece segment is between approximately 50 Hz and 80 Hz.

14. The method of claim 11, wherein the band surrounds an entire circumference of the head of the user.

15. The method of claim 11, further comprising: producing vibrations, by the transducer of the contact points over a range of amplitudes of approximately between 0 to 5 mm.

16. The method of claim 15, further comprising: adjusting, by an amplitude regulating module, an amplitude of the range of amplitudes of the first and/or second frequencies.

17. The method of claim 11, further comprising: sequentially stimulating, by the one or more of the transducers, the first location with the first frequency, and by the at least one nose transducer, the nasal cavity with the second frequency.

18. The method of claim 11, further comprising: simultaneously stimulating, by the one or more of the transducers, the first location with the first frequency, and by the at least one nose transducer, the nasal cavity with the second frequency.

19. The method of claim 11, further comprising: adjusting, by a frequency regulating module, the first and/or second frequencies.

20. The method of claim 11, further comprising: adjusting a pressure, by a pressure regulating module that a respective transducer contacts the user, the pressure ranging between approximately 20 and 120 mbar.

* * * * *